US005737788A

United States Patent [19]

Castellino et al.

[11] Patent Number: 5,737,788

[45] Date of Patent: Apr. 14, 1998

[54] ATTACHING ARRANGEMENT IN A MULTI-LAYERED PAD

[75] Inventors: Robin L. Castellino, Louisville; Gregory S. Marino, Westminster, both of Colo.

[73] Assignee: RIK Medical, LLC, Boulder, Colo.

[21] Appl. No.: 856,914

[22] Filed: May 15, 1997

[51] Int. Cl.[6] ..... A61G 7/057; A47C 27/18

[52] U.S. Cl. ..... 5/655.5; 5/680; 5/685; 5/654; 5/909; 297/452.41

[58] Field of Search ..... 5/655.5, 680, 679, 5/685, 677, 676, 665, 654, 909, 922, 926, 655.9

[56] References Cited

U.S. PATENT DOCUMENTS 5,201,780 4/1993 Dinsmoor, III et al. ..... 5/680
5,255,404 10/1993 Dinsmoor, III et al. ..... 5/677
5,303,436 4/1994 Dinsmoor, III et al. ..... 5/719
5,353,455 10/1994 Loving et al. ..... 5/730
5,511,260 4/1996 Dinsmoor, III et al. ..... 5/685

*Primary Examiner*—Alexander Grosz
*Attorney, Agent, or Firm*—W. Scott Carson

[57] ABSTRACT

A multi-layered pad primarily intended to prevent and treat decubitus ulcers. The pad includes at least first and second layers with the first layer being a bladder made up of separate, discrete pouches containing a viscous fluid. The second layer underlies the fluid bladder layer and is a pillared one of upstanding columns cut in a piece of foam. Each individual pouch is mechanically attached atop its underlying foam column. The attaching arrangement includes a connecting sheet of plastic film wherein the sheet is secured to the pouch and has a central opening in it that goes over and receives the top or head section of the column. The connecting sheet at its opening is received in a slit in the column's wall portion to further help maintain the pouch in place atop its column.

28 Claims, 8 Drawing Sheets

ATTACHING ARRANGEMENT IN A MULTI-LAYERED PAD

BACKGROUND OF THE INVENTION

1. Field of the Invention

This invention relates to the field of mattress and other cushion pads primarily intended for medical use to heal or prevent decubitus ulcers in patients using the pads. It can also be used for other applications requiring the attachment of fluid bladders to foam. More specifically, the invention relates to arrangements for removably attaching fluid bladders or pouches atop spring elements such as foam columns in such pads.

2. Discussion of the Background

Decubitus ulcers, commonly referred to as bed or pressure sores, are a major health concern for patients that become bed or chair bound for prolonged periods of time. They are also frequent complications for burn victims and tall, thin patients and other patients with particularly bony protuberances. The ulcers generally develop at such bony protuberances as well as other relatively bony areas of the patient's body including the trochanteric (hip) area, scapula (shoulder blade) area, spinal area, and coccyx (tailbone) area where relatively little flesh is present and blood circulation is often poor. Factors contributing to the development of the decubitus ulcers are numerous including the general overall condition of the patient's skin and underlying tissue. Forces generated on the patient's body by the mattress pad or other support are also critical.

Examples of a popular mattress pad design that effectively reduces the development of decubitus ulcers using a pillared or columned layer of foam are disclosed in commonly owned U.S. Pat. Nos. 5,201,780, 5,225,404, 5,303,436, and 5,511,260. The basic approach of these patents involves placing a fluid bladder layer over a layer of foam which has had pillars or columns cut into it. The present invention is an improvement over this basic approach and in particular involves an improved design to removably attach the individual pouches of fluid atop the spring pillars or columns of the pad. In the past and in the commonly owned patents mentioned above, such attaching was done primarily by the use of adhesives. For example, an effective method disclosed in these patents involved using patches of two-faced adhesive tape between the foam column and the plastic pouch.

Such two-sided tape created an effective bond but also had its own set of drawbacks. For example, the tape usually needed two types of adhesives—one to bond to the foam of the column and another to bond to the plastic (e.g., urethane) of the fluid pouch. Additionally, not all adhesives effectively bond to all foams so care was needed to correctly match them. In some applications, this limited to some degrees the foam and/or adhesive that could be used. The same was true for the plastic and/or adhesive for the pouch. Further, adhesives by their nature can allow the two bonded parts to creep or move sideways relative to each other. They can also degrade and fail in use particularly in environments like hospital beds where strong disinfectives are used and where the beds can be exposed to bodily fluids from the patient. Another drawback to adhesives and in particular pressure sensitive ones is that they require a relatively high degree of skill to use (e.g., they must be carefully worked into the foam or else they will not achieve adequate bond strength and will fail). This is particularly a problem for field repair or replacement of a pouch as the field facilities and/or personnel may not be conducive to such workmanship requiring the entire mattress to be returned to the plant for repair. Even in the plant, such workmanship and skill must also be carefully monitored. Another drawback of adhesives in the repair aspect of removing and replacing, for example, a torn or ripped pouch is that the original bonding may be too good. Consequently, it may not be possible to remove the failed pouch from the foam column without severely damaging the foam itself and requiring that it be replaced as well.

In this light, the present attaching arrangement was developed. In contrast to the chemical or adhesive arrangements discussed above, the present one is completely mechanical and has none of the drawbacks associated with the use of adhesives. It also offers additional advantages over adhesives including, for example, reducing the frictional forces between the walls of adjacent columns that would normally tend to cause the columns to hang up or bind on one another in use.

SUMMARY OF THE INVENTION

This invention involves a multi-layered pad primarily intended to prevent and heal decubitus ulcers. The pad includes at least first and second layers with the first layer being a bladder made up of separate, discrete pouches containing a viscous fluid. The second layer underlies the fluid bladder layer and is a pillared one of upstanding columns cut in a piece of foam. Each individual pouch is mechanically attached atop its underlying foam column. The attaching arrangement includes a connecting sheet of plastic film wherein the sheet is secured to the pouch and has a central opening in it that goes over and receives the top or head section of the column. The head section is formed and defined in the column by an indentation or slit cut into the column walls and extending about the column. The perimeter of the slit is smaller than the perimeter of the head section and the perimeter of the opening in the connecting sheet is essentially the same size and shape as that of the slit.

In operation, the pouch and connecting sheet form a pocket between them. The head section of the foam column is then manually compressed and passed through the central opening in the connecting sheet where it is allowed to expand to substantially fill the pocket. The perimeter of the opening in the connecting sheet is then received and maintained in the slit in the column. In this manner, the pouch can be easily and quickly attached to the column. Additionally, the pouch can just as easily and quickly be removed from attachment to the column and replaced with another one as desired. The attaching arrangement of the present invention also serves to facilitate the relative movement of adjacent columns to prevent them from binding or hanging up on one another in use.

BRIEF DESCRIPTION OF TEE DRAWINGS

Figure 6:
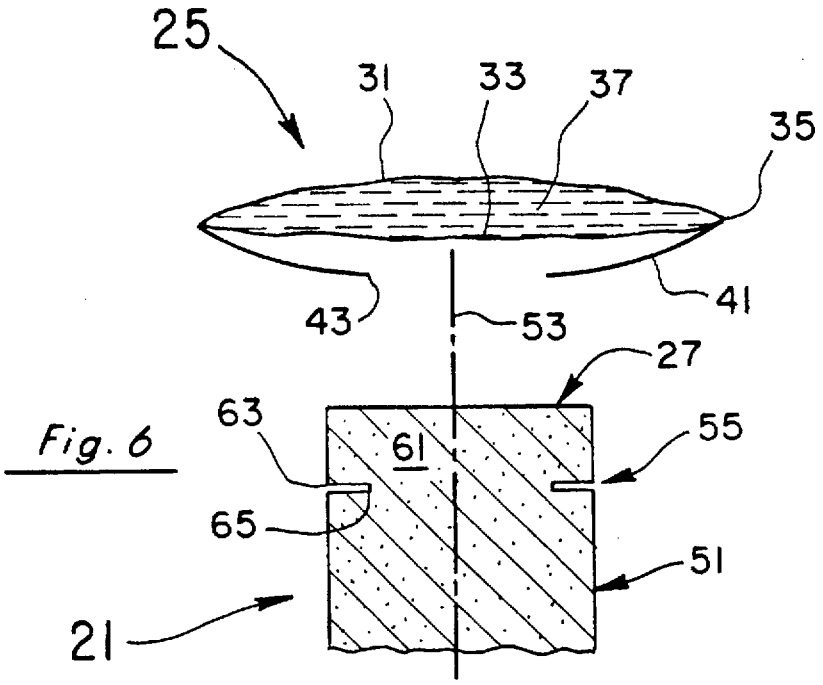
Figure 7:
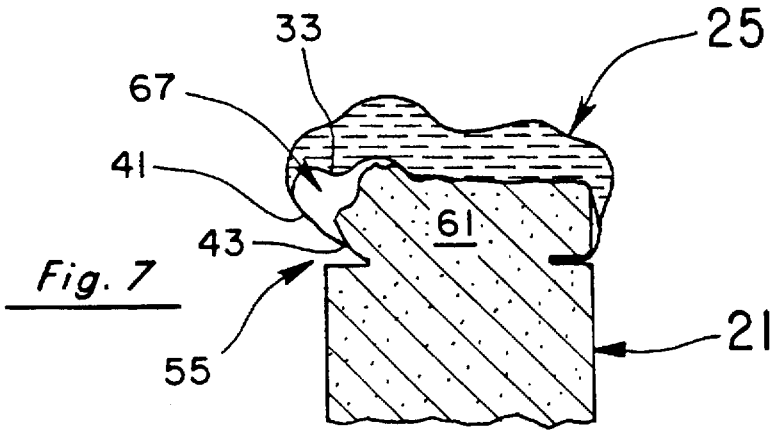
Figure 8:
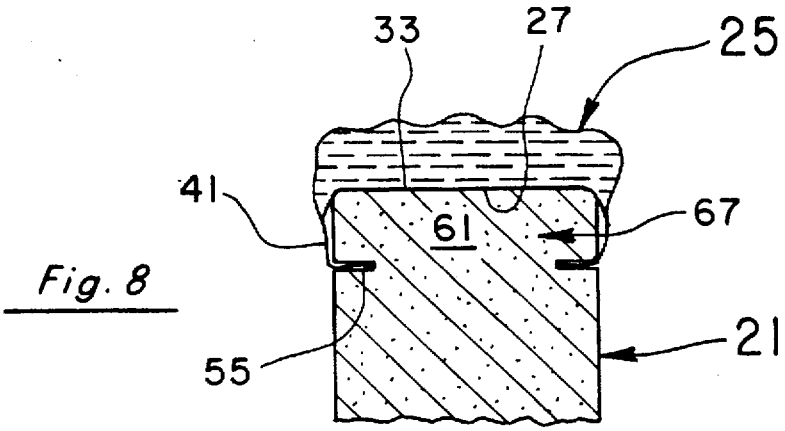

FIGS. 6–8 sequentially illustrate the preferred manner in which each fluid pouch of the bladder layer is attached to the underlying foam column.

Figure 9:
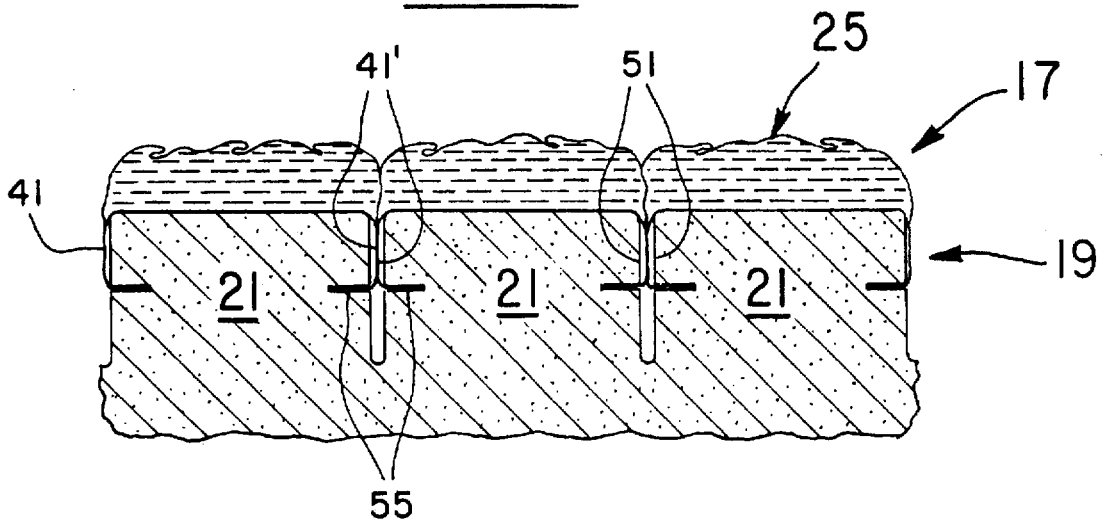
Figure 10:
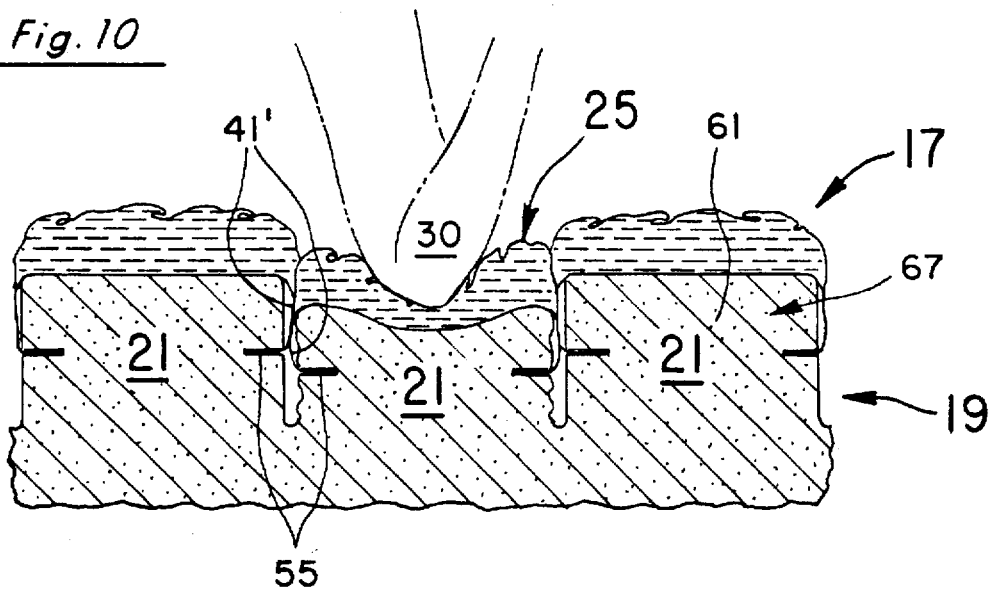
Figure 11:
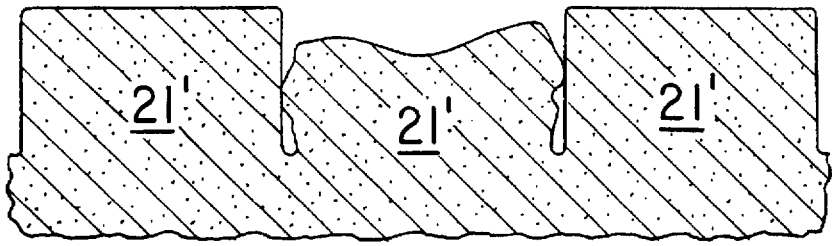
Fig. 11 (Prior Art)

FIGS. 9 and 10 illustrate how the attaching arrangement of the present invention additionally serves to facilitate the relative movement of adjacent columns to prevent them from binding or hanging up on one another as FIG. 11.

FIG. 11 shows how foam columns in prior art approaches tend to bind or hang up on one another in use .

Figure 12:
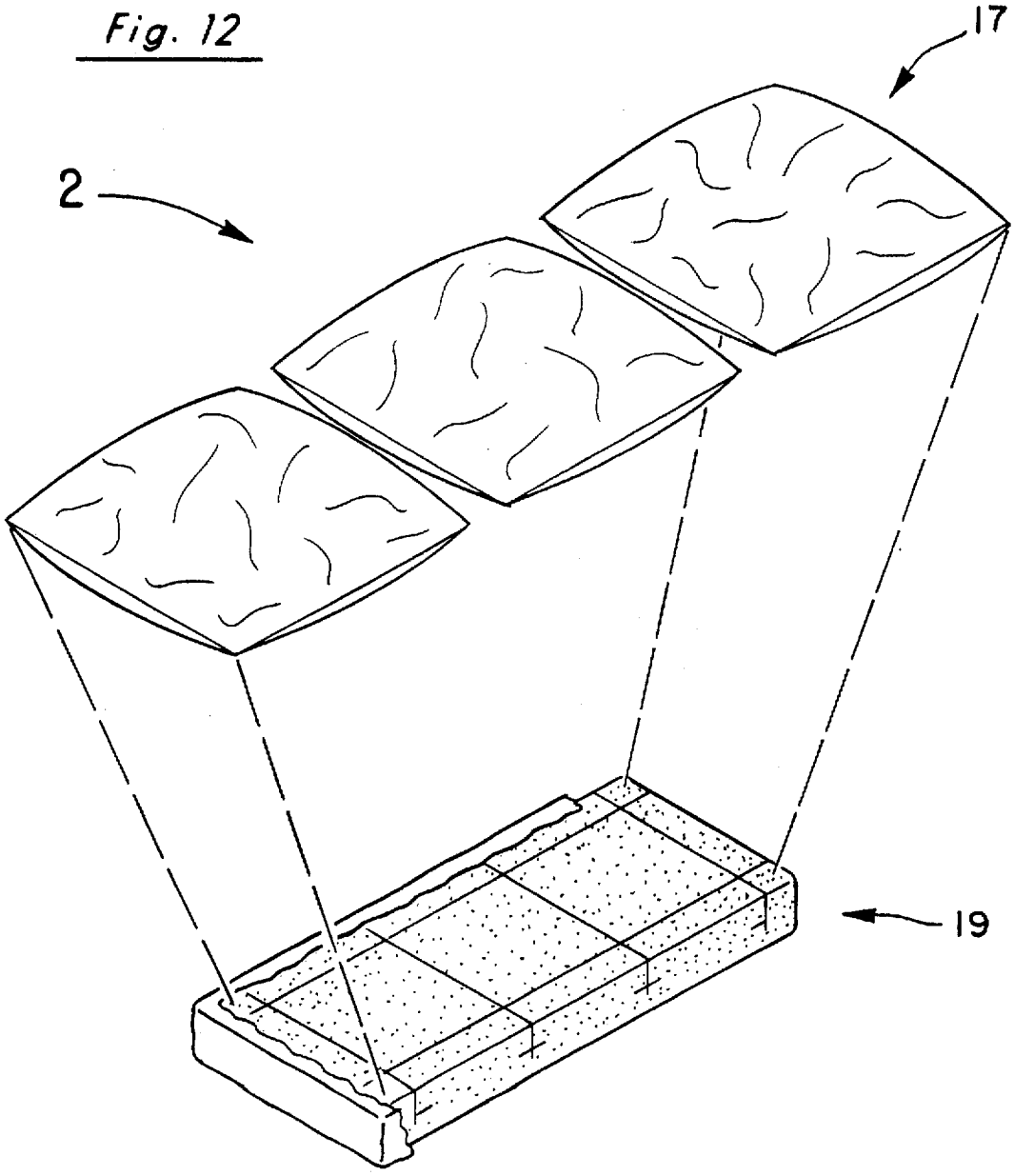

FIG. 12 illustrates the invention present invention adapted for use in a pillow.

Figure 13:
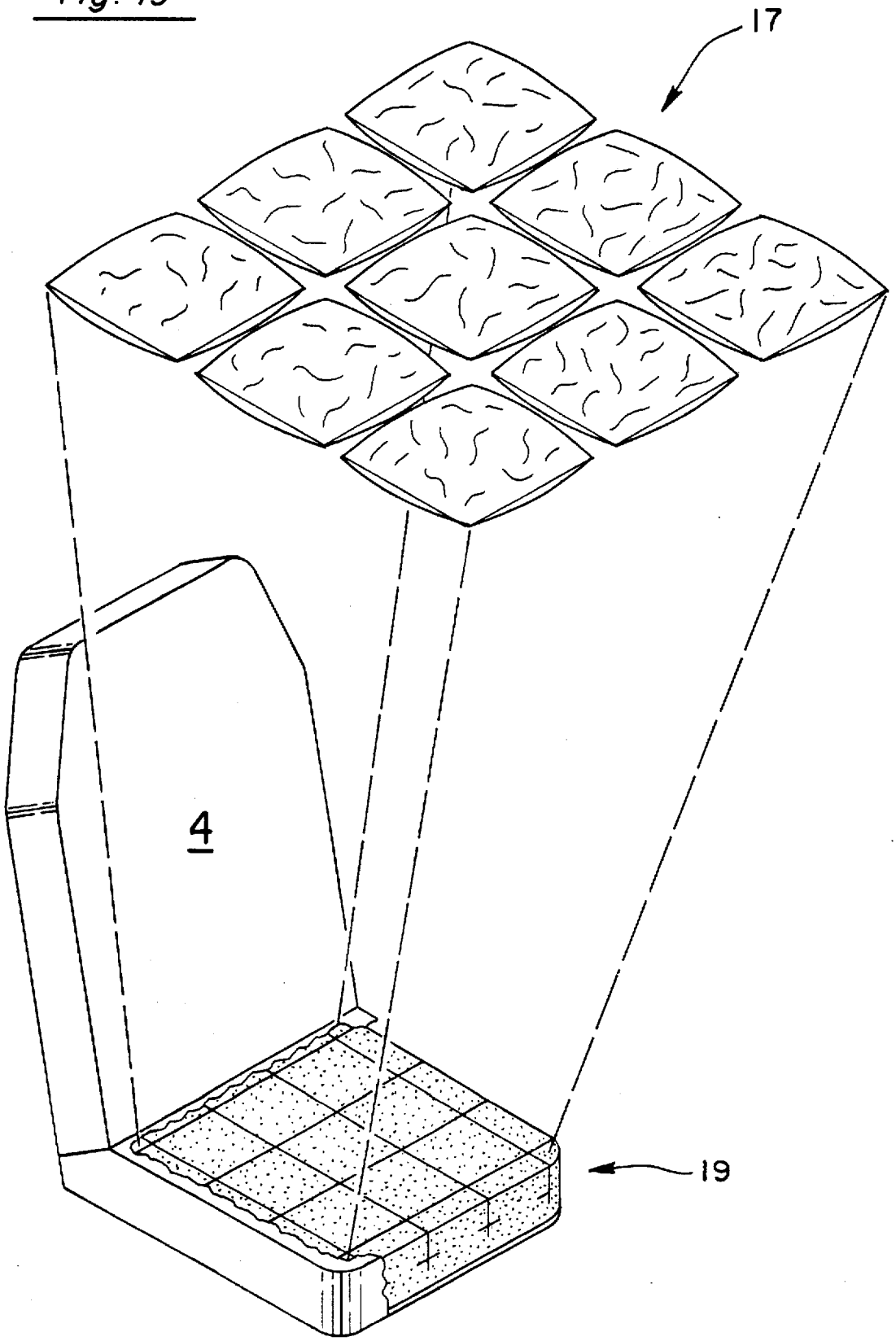

FIG. 13 illustrates the present invention adapted for use in a seat cushion.

DETAILED DESCRIPTION OF THE INVENTION

Figure 1:
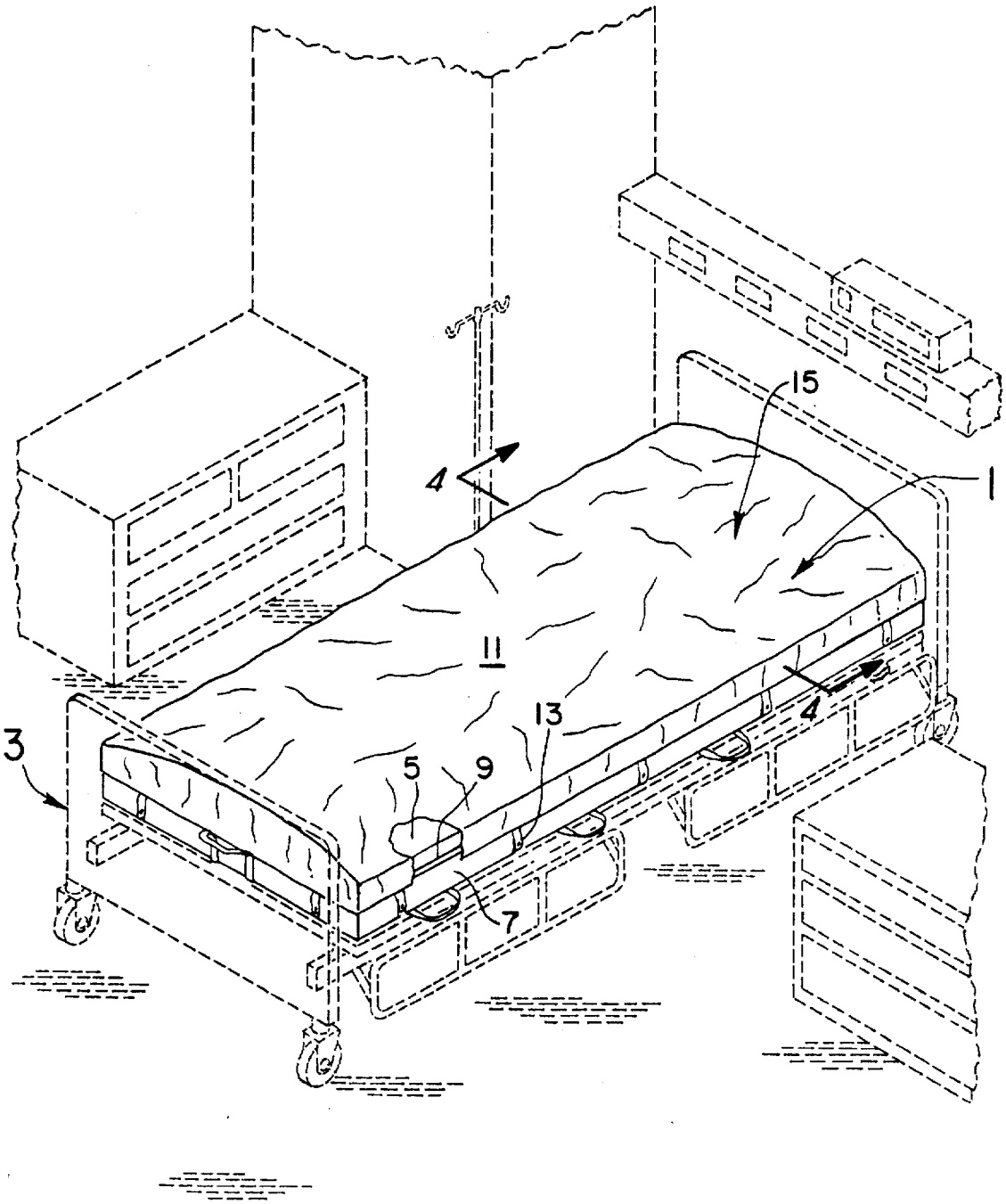
FIG. 1 illustrates the mattress pad of the present invention in use on a standard hospital bed frame.

As shown in FIG. 1, the mattress pad 1 of the present invention is primarily intended for use with a conventional hospital bed frame 3 as a retrofittable replacement for the standard hospital mattress. The pad 1 itself preferably includes a full length, external cover or casing with upper and lower halves 5 and 7 which are zipped together at 9. In the preferred embodiment, the upper half 5 is loose fitting and oversized and also has a hospital sheet 11 loosely fitted on it which is attachable to the cover by an arrangement such as clips 13.

The pad 1 may be divided into one or more sections depending upon the environment (e.g., hospital, home care) for which it is intended. Each section of the pad 1 is multi-layered and in addition to the upper and lower halves 5 and 7 of the external cover, the pad 1 (as illustrated by the exploded view of the head section 15 in FIG. 2) includes a fluid bladder layer 17 which is positioned above a foam layer 19 which has pillars or columns 21 cut into it. Peripheral frame member 23 extends along both sides of the pad 1, substantially covering the length of the pad sides, and is made of a rigid foam. Additionally, the pad 1 may be sectionalized as necessary to meet the needs of a given market. The pad 1 may also be customized to fit the needs of a particular patient.

Figure 2:
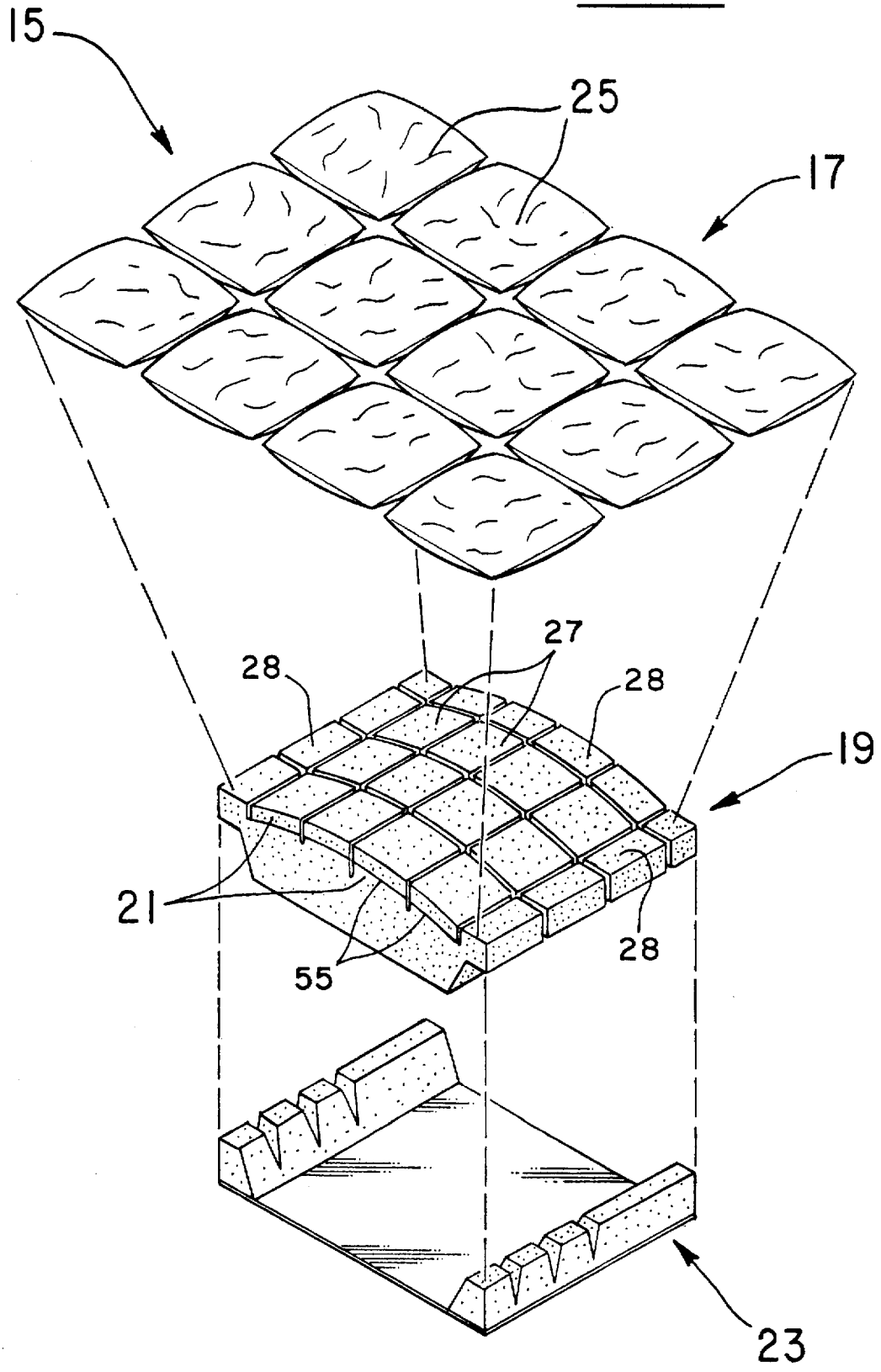
FIG. 2 is an exploded view of the head section of the mattress pad illustrating the fluid bladder layer, pillared foam layer, and peripheral foam frame.
Figure 3:
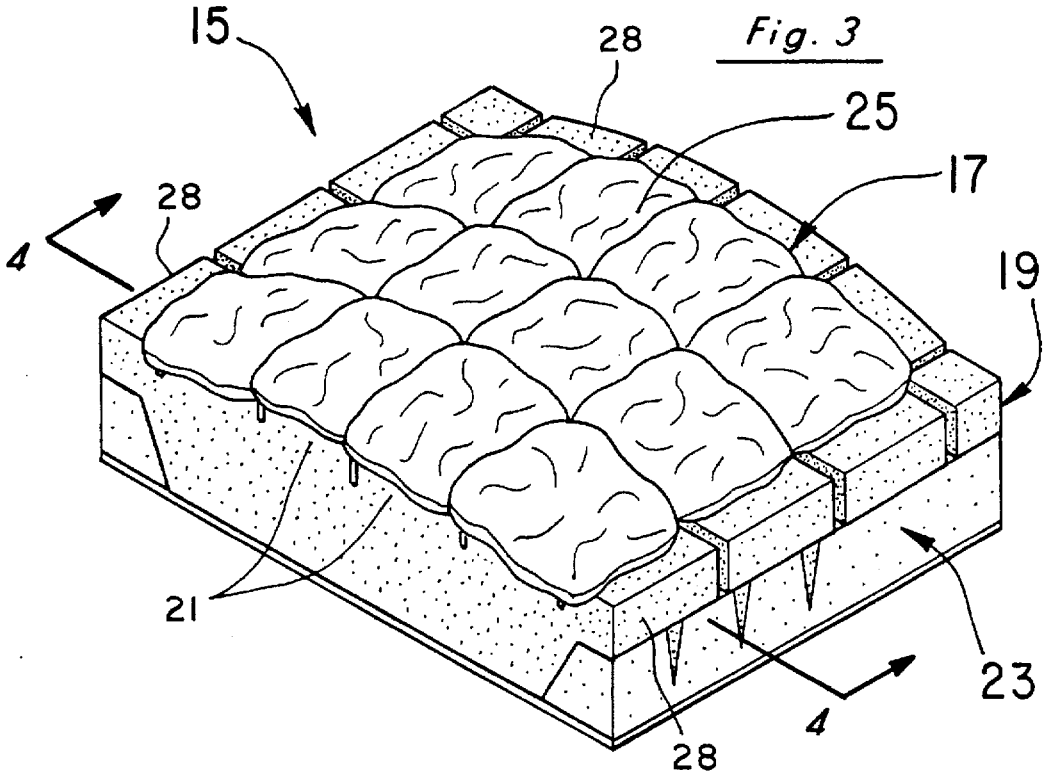
FIG. 3 is a perspective view of the head section of the mattress pad showing the fluid bladder layer positioned atop the underlying layer of foam.
Figure 4:
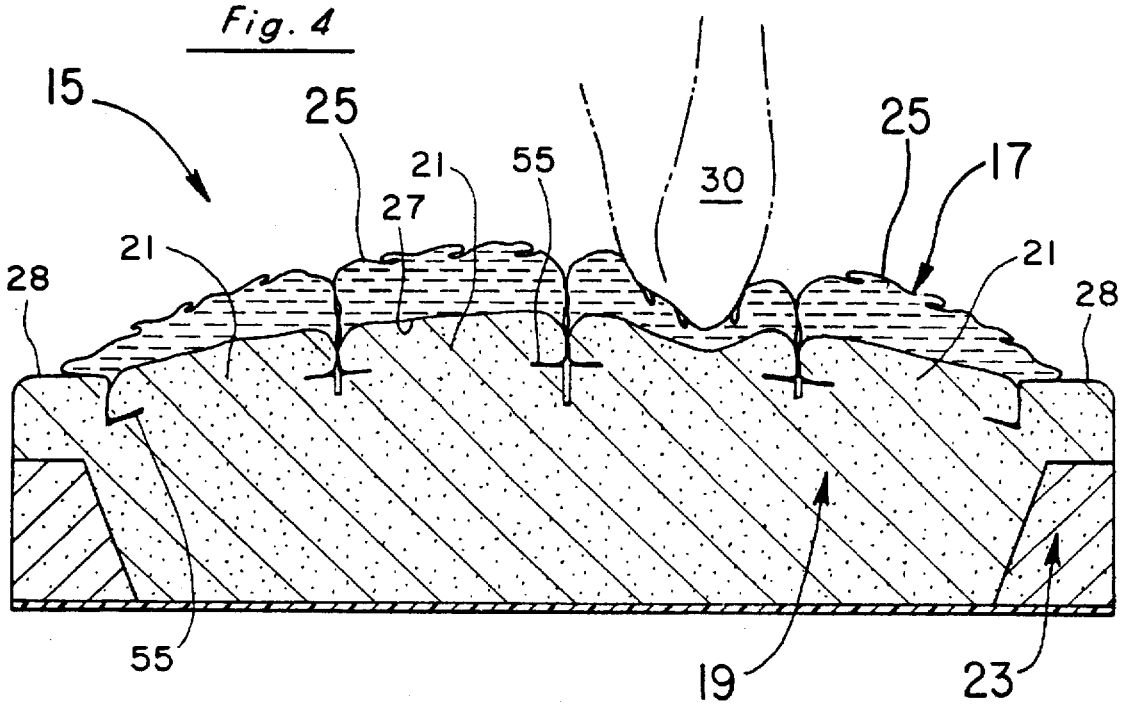
FIG. 4 is a cross-sectional view taken along line 4—4 of FIGS. 1 and 3.

The fluid bladder layer 17 as illustrated in FIG. 2 is made up of a plurality of separate, discrete pouches 25 filled with fluid. The pouches 25 as discussed in more detail below are assembled and arranged to essentially form a continuous bladder layer 17 of fluid atop the underlying foam layer 19 (see FIGS. 3 and 4). Each pouch 25 (see FIGS. 2 and 4) is oversized relative to the upper surface 27 of the column 21 it overlies. Taken together, the entire bladder layer 17 is also oversized relative to the columns 21 of the foam layer 19 it overlies. Such oversizing simply means that prior to the fluid layer 17 being secured atop the foam layer 19, the fluid layer 17 of FIG. 2 normally occupies an area substantially larger than (e.g., four times as large as) the area of the foam layer 19 underneath it. This overall relative sizing in the preferred embodiment of FIG. 2 is accomplished by making the area of each fluid pouch 25, for example, four times the area of the upper surface 27 of the column 21 to which the pouch 25 will be attached. In this regard, both the width and length of the pouch 25 are about twice the corresponding width and length of the underlying column 21 so the oversizing is preferably in all directions. This is true whether the column surface 27 is rectangular, square (e.g., 5½ inches), round, or otherwise. The border or edge pillars 28 about the central foam columns 21 in FIG. 2 are preferably not capped with fluid pouches. However, the fluid pouches 25 on the immediately adjacent columns 21 next to the smaller, border pillars 28 are preferably dimensioned and positioned to overlie portions of the border pillars 28 as illustrated in FIGS. 3 and 4.

When secured over the underlying foam layer 19 (see FIG. 3), the oversized bladder layer 17 is relatively loose and bunched atop layer 19. This same oversizing is also provided in the upper half 5 of the external cover or casing for the mattress pad 1 as well as any other topping layers such as the hospital sheet 11 in FIG. 1. In this manner, pad layers 17 and 19 can be depressed under the entire weight of the patient's body or any of its parts (e.g., elbow 30 in FIG. 4) without drawing layer 17 or any layers above it taut like a hammock.

Figure 5:
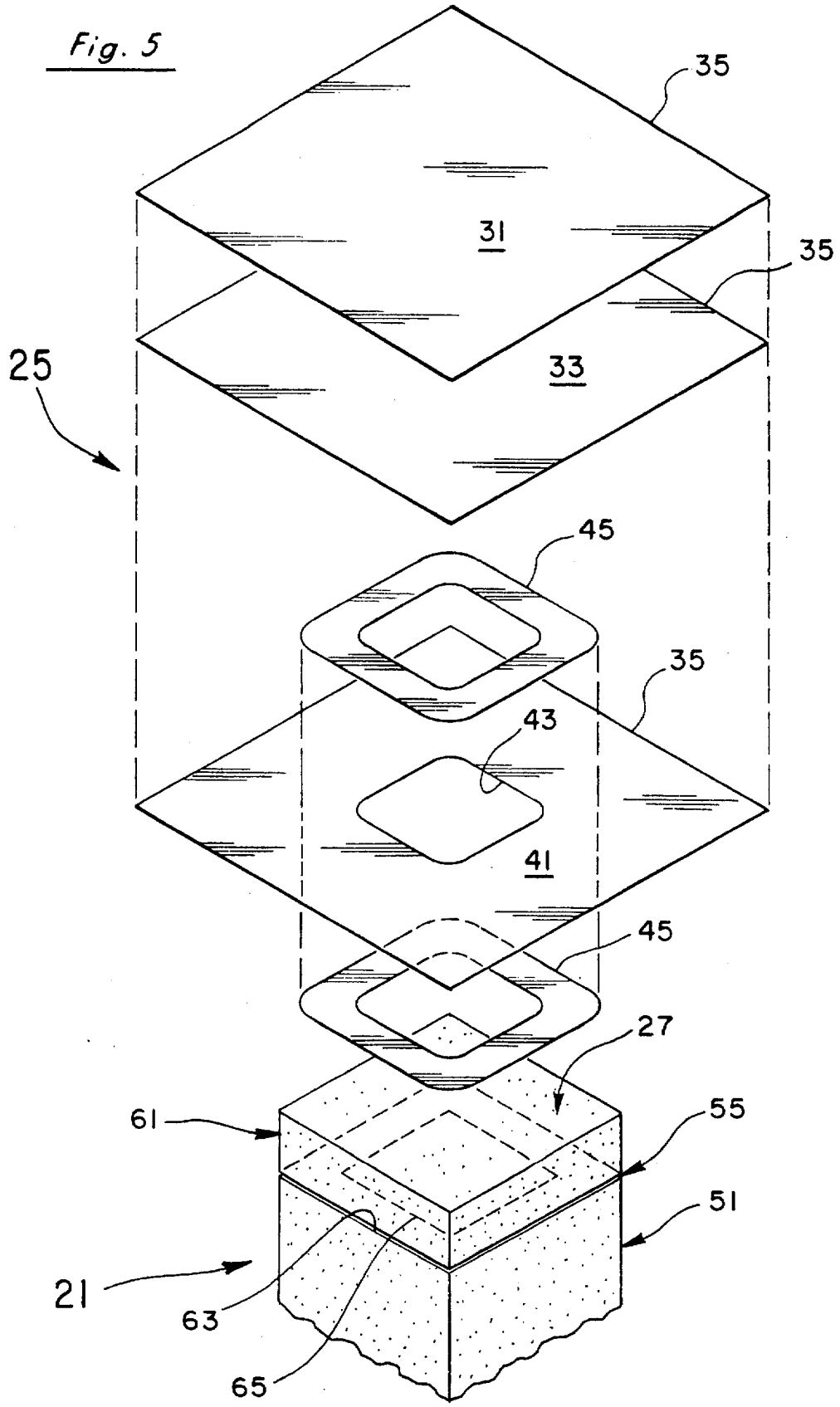
FIG. 5 is an exploded view of a pouch of the fluid bladder layer and the connecting sheet that helps attach it to the underlying pillar or column of foam.

Vertical or normal pressures and reaction forces on the patient's body are reduced and minimized primarily by the fluid bladder layer 17 and the underlying foam layer 19. The fluid bladder layer 17 as discussed above preferably has a plurality of discrete pouches 25 (see FIG. 2). Each pouch 25 as shown in the exploded view of FIG. 5 preferably has at least upper and lower plastic sheets 31, 33 (e.g., urethane). The plastic sheets 31, 33 are preferably the same size and shape and are sealed to each other about their perimeters 35 with the fluid 37 (see FIG. 6) contained therebetween. Beneath the fluid pouch 25 (see again FIG. 5) and preferably secured to it at its perimeter 35 is a connecting sheet 41 of plastic or other material. The outer perimeter 35 of the connecting sheet 41 is also preferably the same size and shape as the perimeters 35 of pouch sheets 31, 33 so that they can all be cut and bonded (e.g., sonic or radio frequency welding) essentially at the same time. The connecting sheet 41 as illustrated in FIG. 5 has a central opening or hole 43 which is preferably reinforced by relatively stiff, plastic patches 45 (e.g., nylon). The connecting sheet 41 and any reinforcing patches 45 can be made of a number of materials but preferably are relatively inelastic so they do not appreciably stretch in use as discussed below. The sheet 41 itself is preferably a thin plastic film (e.g., 3–10 thousandths of an inch thick urethane) with outer and inner perimeters 35 and 43 giving it an overall, substantially annular shape.

The connecting sheet 41 is part of the attaching arrangement of the present invention wherein each pouch 25 is mechanically and removably attached or secured to the underlying pillar or column 21. In this manner, each pouch 25 can be easily and quickly attached and secured to the underlying column 21. Additionally, each pouch 25 can just as easily and quickly be removed and replaced with another pouch 25 should the original one, for example, become ripped or otherwise fail.

To initially attach a pouch 25 to its underlying foam pillar or column 21, the fluid pouch 25 is first positioned above the column 21 as shown in FIG. 6. The column 21 in FIG. 6 is preferably made of resilient, compressible foam and has an upper surface 27 and wall portion 51. The upper surface 27 of the column 21 as illustrated extends about the column axis 53 and the wall portion 51 thereof extends about and along the column axis 53. An indentation or slit 55 is cut in the wall portion 51 to extend inwardly (e.g., ⅞ inch) therefrom about the column axis 53 to form and define a head section 61. The head section 61 as shown extends from the indentation or slit 55 upwardly to the upper surface 27 of the column 21. The perimeter 63 of the column's head section 61 at the indentation 55 (see FIG. 6) is larger than the perimeter 65 of the column 21 at the base of the indentation 55. The perimeter of the central opening or hole 43 in the connecting sheet 41 is preferably the same size and shape as the perimeter 65 of the indentation or slit 55.

In operation and after the pouch 25 is positioned above the column 21 (FIG. 6), the head section 61 of the foam column 21 is manually compressed and passed through the central opening 43 in the connecting sheet 41 (FIG. 7). Thereafter, it is allowed to expand (FIG. 8) and substantially fill the pocket 67 formed between the connecting sheet 41 and the lower sheet 33 of the pouch The perimeter of the opening 43 in the connecting sheet 41 is then received and maintained in the indentation or slit 55 in the column 21 to position the pouch 25 atop the upper surface 27 of the column 21 (FIG. 8). The connecting sheet 41 at least at the perimeter of the central opening 43 is preferably inelastic and will maintain its size and shape as the compressed head section 61 is allowed to expand into the pocket 67. In this regard, the depth of slit 55 can be less since the sheet 41 is inelastic and not easily stretched by the forces generated on it tending to pull it out of the slit 55.

The indentation 55 as discussed above is preferably a slit (e.g., 1/16 inch wide) located along the wall portion 51 of the respective column 21 spaced from the column's upper surface 27. Depending upon the height of the column 21 and/or the desired volume of the pocket 67, the actual location of the slit 55 can vary from near the top of the column 21 (FIG. 6) to near or even at the base of the column 21 (see the outer columns 21 on the left and right sides in FIG. 4). Alternatively, the slit could be a simple undercut depending on the desired performance of the foam pillar or column, which is application specific.

Regardless of the exact location of the slit 55 along the column's wall portion 51, the connecting sheets of plastic film 41 secured to adjacent columns 21 (see FIG. 9) will have portions 41' immediately adjacent and preferably contacting one another in use. Consequently, as shown in FIG. 10, the attaching arrangement of the present invention offers the additional advantage that adjacent columns 21 will be less likely to bind or hang up on one another in use. That is, the contacting portions 41' offer a fairly slick or slippery abutment or boundary between adjacent wall portions 51 of adjacent columns 21. This in turn facilitates movement of the columns 21 relative to each other as the adjacent portions 41' may abut and slide by one another as for example as the central column 21 in FIG. 10 is initially depressed. It also facilitates such relative movement as the central column 21 is further depressed wherein portions 41' on the two outer columns 21 in FIG. 10 may abut and slide against the plastic of the pouch 25 on the central column 21. In this regard, the connecting sheets 41 anchored in slits 55 thereby ensure that at least the head sections 61 captured in the pockets 67 will easily slide by one another and not bind or hang up on each other as is the tendency of uncovered columns (and in particular foam columns) to do such as 21' in FIG. 11. Stated another way, the pouches 25 and connecting sheets 41 form caps over the head sections 61 of the columns 21. Since the caps are make of slicker or lower friction material (e.g., plastic) than the columns 21 (e.g., foam), the caps more easily slide by each other as the columns 21 contact and are moved relative to each other as in FIG. 10. Such capping of the head sections 61 also permits the use of narrower gaps between the columns because of the reduced tendency of the columns 21 to bind on one another.

The fluid within the bladder pouches 25 is preferably a viscous liquid such as a plastic or viscous thixotropic material which flows gradually when pressure is applied to it but which maintains its shape and position in the absence of pressure. In most cases, the preferred fluid is an incompressible liquid with a viscosity greater than the viscosity of water (preferably several times greater) in addition to exhibiting the above-mentioned thixotropic properties. However, in some applications, the fluid could be air, water, or oil as well as water-based or oil-based compounds if desired. Each pouch 25 is preferably only partially filled (e.g., 40% to 70%) with fluid so there is no distending or tensioning of the pouches 25 in use. As shown, each form column 21 when loaded axially can deflect downwardly essentially independently of all adjacent columns 21 allowing the attached fluid bladder pouch 25 to conform to irregular body shapes (e.g., the illustrated elbow 30 in FIGS. 4 and 10) without bottoming out and without drawing the layer 17 taut like a hammock. This is turn results in the mattress pad 1 supporting all parts of the patient's body with substantially the same, relatively low pressure with few if any localized pressure points. The resulting pressure is then preferably designed to be below that pressure at which capillary blood flow is blocked or occluded (e.g., about 30 millimeters of mercury).

While several embodiments of the invention have been shown and described in detail, it is to be understood that various modifications and changes could be made to them without departing from the scope of the invention. For example, although the present invention is shown and described primarily as a mattress pad, it is equally adaptable for other applications such as pillows (see pillow 2 in FIG. 12) and seat or back pads (see chair cushion 4 in FIG. 13). Also, the underlying layer 19 has been shown and described primarily as being made with resilient columns or spring elements of foam but in many applications, the improvements of the present invention could be equally adapted for use with resilient columns or spring elements of pneumatic, liquid, or coil spring designs. In such applications and depending upon the compressibility of the spring element, the connecting sheet may preferably be elastic, particularly about its opening through which the spring element is passed.

We claim:

1. In a multi-layered pad having at least first and second layers, said first layer including bladder means for containing fluid, said second layer being positioned beneath said first layer and including at least one upstanding column of resilient, compressible material, said column extending substantially about and along an axis, said column having an upper surface extending substantially about said axis and further having a wall portion extending substantially from said upper surface substantially about and along said axis, the improvement including:

means for removably attaching said first layer to said second layer with the bladder means of said first layer positioned substantially atop the upper surface of the resilient column of said second layer, said attaching means including an indentation extending inwardly from the wall portion of said column and substantially about said axis to define a head section of said column, said head section extending from said indentation to the upper surface of said column, said head section having a first perimeter about said axis and said column at said indentation having a second perimeter about said axis, said second perimeter being smaller than said first perimeter, said attaching means further including connecting means with an opening defined by a perimeter, said opening perimeter being less than the first perimeter of said column, said connecting means being secured to said first layer and said opening perimeter being receivable in said indentation in the wall portion of said column wherein said first layer can be removably attached to said second layer with said bladder means positioned atop the upper surface of said column by compressing the head section of said column to pass through the opening perimeter of said connecting means whereby the opening perimeter of said connecting means is received and retained in the indentation in said wall portion of the column.

2. The improvement of claim 1 wherein said second perimeter of said column at said indentation and the opening perimeter of said connecting member are substantially the same shape.

3. The improvement of claim 2 wherein said shape is substantially rectangular.

4. The improvement of claim 3 wherein said shape is substantially square.

5. The improvement of claim 1 wherein said second perimeter of said column at said indentation and the opening perimeter of said connecting member are substantially the same size.

6. The improvement of claim 1 wherein said second perimeter of said column at said indentation and the opening perimeter of said connecting member are substantially the same shape and size.

7. The improvement of claim 1 wherein said bladder means has a pouch with a perimeter, said connecting means has an outer perimeter greater than said opening perimeter, and said pouch and said connecting means are secured to each other substantially adjacent the perimeter of the pouch and the outer perimeter of the connecting member.

8. The improvement of claim 7 wherein the perimeter of the pouch and the outer perimeter of the connecting member are substantially the same shape.

9. The improvement of claim 8 wherein said shape is substantially rectangular.

10. The improvement of claim 9 wherein said shape is substantially square.

11. The improvement of claim 7 wherein the perimeter of the pouch and the outer perimeter of the connecting member are substantially the same size.

12. The improvement of claim 7 wherein the perimeter of the pouch and the outer perimeter of the connecting member are substantially the same shape and size.

13. The improvement of claim 1 wherein said first layer and said connecting means secured thereto form a pocket whereby the head section of said column is compressed to pass through the opening perimeter of said connecting means and thereafter allowed to expand into said pocket to retain said first layer attached to said second layer.

14. The improvement of claim 1 wherein said connecting member has an outer perimeter and said opening perimeter and outer perimeter define a substantially annular shape.

15. The improvement of claim 1 wherein said indentation in said wall portion of said column is a slit extending substantially about the axis of said column.

16. The improvement of claim 1 wherein said connecting member at least adjacent said opening perimeter is made of substantially inelastic material.

17. The improvement of claim 1 wherein said connecting member is a thin sheet of plastic film.

18. The improvement of claim 1 wherein said fluid has a viscosity greater than the viscosity of water.

19. The improvement of claim 1 wherein said resilient, compressible column is made of foam.

20. The improvement of claim 1 wherein said pad is a substantially full length mattress pad with a plurality of substantially identical columns and said bladder means has a plurality of discrete, separate pouches filled with fluid wherein substantially each pouch is removably attached to one of said columns.

21. The improvement of claim 1 wherein said bladder means filled with fluid has a perimeter substantially greater than the perimeter of the upper surface of said column wherein said bladder means is oversized relative to the upper surface of said column.

22. A multi-layered pad having at least first and second layers, said first layer including bladder means with at least first and second, discrete, separate pouches filled with fluid, said second layer being positioned beneath said first layer and including at least first and second, adjacent, upstanding columns of resilient material, each column respectively extending substantially about and along an axis, each column further having an upper surface extending about the axis of the respective column and a wall portion extending from the respective upper surface substantially about and along the axis of the respective column, said pad further including:

means for removably attaching said first and second pouches respectively to said first and second adjacent columns with each pouch respectively positioned atop the upper surface of the underlying column, said attaching means including first connecting means secured to said first pouch and having means for removably securing said first connecting means to the wall portion of said first column at a location along said wall portion spaced from the upper surface of said first column and second connecting means secured to said second pouch and having means for removably securing said second connecting means to the wall portion of said second column at a location along said wall portion spaced from the upper surface of said second column, said first and second connecting means having portions thereof positioned immediately adjacent one another substantially between adjacent wall portions of adjacent columns to facilitate movement of said adjacent columns relative to each other.

23. The multi-layered pad of claim 22 wherein said first and second columns are made of foam.

24. The multi-layered pad of claim 22 wherein said first and second connecting means are made of plastic film.

25. The multi-layered pad of claim 22 wherein said first and second connecting means are made of substantially inelastic material.

26. The multi-layered pad of claim 22 wherein said attaching means includes an indentation extending inwardly from the wall portion of each column and substantially about the axis of each column, said first connecting means having a portion received and retained in the indentation in the wall portion of said first column and said second connecting means having a portion received and retained in the indentation in the wall portion of said second column.

27. The multi-layered pad of claim 26 wherein said first pouch and said first connecting means secured thereto form a pocket to receive a head section of said first column therein, said head section extending from the indentation in said wall portion of said first column to the upper surface of said first column and wherein said second pouch and said second connecting means secured thereto form a pocket to receive a head section of said second column therein, said head section extending from the indentation in said wall portion of said second column to the upper surface of said second column.

28. The multi-layered pad of claim 22 wherein each of said first and second columns has a head section extending from the respective location along the respective wall portion thereof to the upper surface of the respective column and wherein said first pouch and said first connecting means attached to the wall portion of the first column form a first cap over the head section of said first column and said second pouch and said second connecting means attached to the wall portion of the second column form a second cap over the head section of said second column wherein at least portions of said first and second caps are made of slicker material than said columns and slidably contact one another as the head sections of the adjacent first and second columns are moved relative to each other to thereby facilitate such movement.

* * * * *